US006607377B2

(12) United States Patent
Latzel

(10) Patent No.: US 6,607,377 B2
(45) Date of Patent: Aug. 19, 2003

(54) CANDLE HOLDER FOR MOUNTING ON A SUPPORT

(76) Inventor: Peter Latzel, Letzestrasse 45, A-6800 Feldkirch (AT)

( * ) Notice: Subject to any disclaimer, the term of this patent is extended or adjusted under 35 U.S.C. 154(b) by 0 days.

(21) Appl. No.: 10/118,501

(22) Filed: Apr. 5, 2002

(65) Prior Publication Data

US 2002/0177092 A1 Nov. 28, 2002

(30) Foreign Application Priority Data

Apr. 5, 2001 (DE) ..... 201 06 004 U

(51) Int. Cl.[7] ..... F23D 3/16
(52) U.S. Cl. ..... 431/295; 431/289
(58) Field of Search ..... 431/295, 289, 431/297, 253; D26/10, 12, 13

(56) References Cited

U.S. PATENT DOCUMENTS 941,213 A 11/1909 Guelpen
1,439,243 A * 12/1922 Hughes et al. ..... 248/277.1
1,721,273 A * 7/1929 Johnson ..... 362/392
1,940,841 A * 12/1933 Benziger ..... 431/295
3,303,611 A * 2/1967 Erbguth ..... 47/41.11
3,619,599 A * 11/1971 Hermanson ..... 362/250
4,529,160 A * 7/1985 Chan et al. ..... 248/436
4,884,966 A * 12/1989 Wexler ..... 431/295

FOREIGN PATENT DOCUMENTS

FR 2.154354 11/1973
JP 359046421 A * 3/1984

* cited by examiner

*Primary Examiner*—Alfred Basichas

(57) ABSTRACT

Candle holder for mounting on a support, such as a bakery product, comprising at least two candle mounts which are displaceable relative to one another so that the wicks of at least two candles present in each case on the candle mounts can be brought into an ignition distance relative to one another in a first position and can then be moved into a second position in which the wicks are a larger distance apart.

9 Claims, 5 Drawing Sheets

CANDLE HOLDER FOR MOUNTING ON A SUPPORT

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates to a candle holder for mounting on a support, such as a bakery product.

TECHNICAL FIELD

Candle holders for holding and for mounting candles on a support, for example on a bakery product, are used on many festive occasions. A typical intended use is the application of a number of candles associated with the age to a birthday cake.

Typical problems generally arise through the number of candles which have to be placed with increasing age of a person celebrating his or her anniversary and which have to be anchored in the generally only slightly stable mass of the bakery product in a small space, and for the lighting and burning of candles. In addition to the difficulties of handling, the contamination by soot and wax which arises from the burning of the candles gives rise to at least aesthetic limitations. A very fast and easy lighting of a relatively large number of candles presents a further difficulty.

U.S. Pat. No. 3,819,455 discloses a hood-like cake protector which is also equipped for holding candles. The fastening and retention are effected here without direct contact with the cake by inverting over the cake protector in which the candles rest in fixed mounts unchangeable in their positioning.

U.S. Pat. No. 4,721,455 describes a construction which can be pushed onto or into a cake and has candle mounts around a cylindrical center.

U.S. Pat. Nos. D 285,159, 4,938,688 and 4,884,966 disclose protective plastic cake covers which have a number of holes into which candles can be inserted. In one embodiment, a special arrangement of the holes enables numerical symbols represented as figures and comprising candles to be inserted.

U.S. Pat. No. 298,859 describes a shield-like cake attachment which can be pushed into a cake and has, on its upper surface, holders for a few candles.

However, none of these publications describes a possibility for fast and easy lighting of candles, in particular a relatively large number thereof, as are used especially on birthdays, company anniversaries and other celebrations. In all cases, the candles must be lit individually, which proves to be particularly disadvantageous since, in addition to the complicated handling, nonuniform burning of the candles results, which is aesthetically not very advantageous and, in the most unfavorable case, can result in the candles lit first already going out before the last candle burns. In particular, candle size and number of candles are negatively correlated with one another owing to the limited space available on a bakery product, so that an individually short burning time of the candles is likely in the case of large numbers of candles and the problems described may occur to a greater extent.

U.S. Pat. No. 6,186,766 B1 describes a candle lighting system for fast lighting of a plurality of candles. There, the candles are lit by means of a burnable connection from candle to candle by means of a fuse cord. This solution has the disadvantage that special candles or candle attachments have to be used and the lighting process is likely to release a relatively large amount of combustion substances, which in turn can contaminate the cake or the surrounding air. Because of the requirements associated with the handling of many ignition leads, their use for a relatively large number of candles is complicated and susceptible to problems.

U.S. Pat. No. 5,439,376 discloses a special type of candle which has a lighting cord connected to the wick and is likewise lit by means of a fuse. In addition to the disadvantages already described for the preceding solution and also relevant here, the difficulty of correct transmission of the igniting flame from the lead to the candle wick additionally occurs.

SUMMARY OF THE INVENTION

The object of the present invention is to provide a candle holder, in particular for a relatively large number of candles, which permits the lighting of all candles quickly and easily without having to use special igniting leads.

This object is achieved, according to the invention, by a candle holder for mounting on a support, such as a bakery product, including at least two bearer elements, on each of which at least one candle mount is mounted, wherein the bearer elements are displaceably connected to one another, in a first position of the bearer elements, it being possible for wicks of at least two candles introducible or introduced in each case into the candle mounts to be brought into an ignition distance relative to one another and it being possible for the bearer elements then to be moved, in particular pushed, turned or folded, into a second position in which the wicks are a larger distance apart. Advantages and alternative embodiments and further developments of the apparatus are evident from the following description of the invention.

In the subject of the invention, the candles are held in mounts which can be moved relative to one another in such a way that, in a first position, easy and fast lighting of the candles is possible and said position is determined so that wicks of the candles are present an ignition distance apart. Owing to the geometric conditions, it will in general not be possible to find a position of all wicks in which the lighting of a single candle leads to transmission of the flame to all remaining candles.

An embodiment comprises bringing together the candle mounts and hence the wicks in a plurality of rows of candles so that the candles to be lit are reduced to the candles present in each case at the front position in the rows. The candle holder is held in such a way that the candles of a row are present perpendicularly one on top of the other and, as a result of lighting the wick of the lowermost candle, transfer to the candle above by the "upward burning" of the flame is possible.

If the distance of the rows from one another is chosen so that the ignition distance is reliably exceeded, it is possible to ensure that only the intended part of the candles is ignited quickly in succession and uncontrolled burning is avoided. This makes it possible to take into account particular risk aspects associated with specific groups of persons, such as, for example, children.

After all candles have been lit, their spacing is increased by moving the candle mounts until, after reaching or assuming a second position, which, for example, may meet decorative requirements, it is possible to mount the holder on a support.

The individual candle mounts can be mounted on bearer elements which can be displaced, rotated, tilted or moved in another manner relative to further bearer elements present. The second position designed for mounting of the candle holder may have a form which primarily conforms to decorative aspects but must also take account of the mechanical requirements of the movement. A ring, star, fan, shield, grid or spiral represents a suitable form. A movement of the components, such as, for example, the bearer elements, from the first to the second position and vice versa can be effected by means of generally known mechanical connections, such as, for example, joints, flexible connections or sliding connections.

The movement can take place in a plane as well as include changes in further dimensions, for example folding together of a plurality of arm-like bearer elements toward a common center. The first position thus assumed may have, for example, the form of a spherical cap or a pyramid, in the center of which or at the vertex of which all wicks or at least a relatively large proportion of the wicks have been brought within an igniting distance of one another. After lighting, the bearer elements can be moved back to their position. Arrangement of the candle mounts or bearer elements in different planes or at different angles is also possible, for example their terraced or step-like arrangement can help to give a particular impression of the candle holder.

The production of a plurality of components of the candle holder, including the candles, from a single, common material permits integrated, simple and economical production, for example of disposable candle mounts for events which have a singular character, such as, for example, a golden wedding anniversary or an eightieth birthday.

BRIEF DESCRIPTION OF THE DRAWINGS

The candle holder according to the invention is described in more detail below, purely by way of example, with reference to embodiments shown schematically in the drawing.

DETAILED DESCRIPTION OF THE INVENTION

Figure 1A:
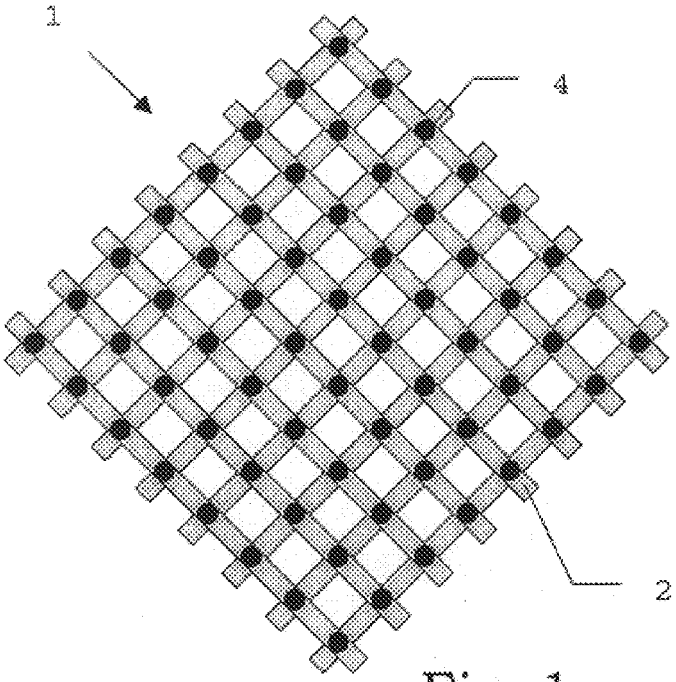
FIG. 1*a* shows an overall view of the exemplary embodiment of a candle holder according to the invention, in plan view.

FIG. 1*a* shows an overall view of the exemplary embodiment of a candle holder according to the invention, in plan view, which candle holder consists of a plurality of bearer elements 2 which are connected to one another in a grid by means of pivot points in a scissors-like manner. Candles 4 are mounted at the points of intersection of the bearer elements 2. The embodiment shown by way of example has the same distances between the candles 4 in the second position which is suitable for mounting on a support, which represents only one of a plurality of possible embodiments. Mounting on the support and fixing there may be facilitated, for example by spike-like or nail-like extensions on that side of the candle holder which is opposite the candles 4.

Figure 1B:
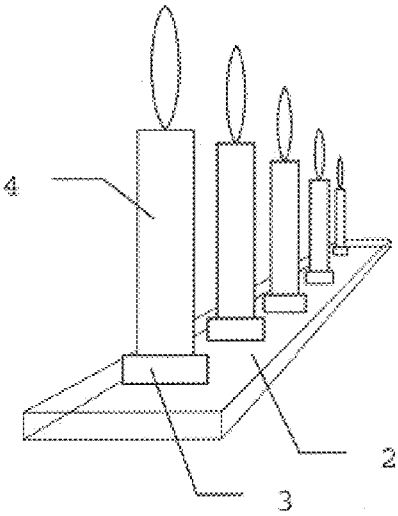
FIG. 1*b* shows the view of a bearer element with burning candles.

FIG. 1*b* shows one of the bearer elements 2 individually and on a larger scale. Candle mounts 3 are fastened in a linear arrangement on the bearer element 2 and in turn hold candles 4. Since the candles 4 are fastened to the bearer elements 2 by means of the candle mounts 3, candle mounts 3 are no longer shown in the following figures although they are always taken into account as a suitable fastening means without wishing herewith to justify the exclusiveness of this apparatus for candle fastening.

Figure 2A:
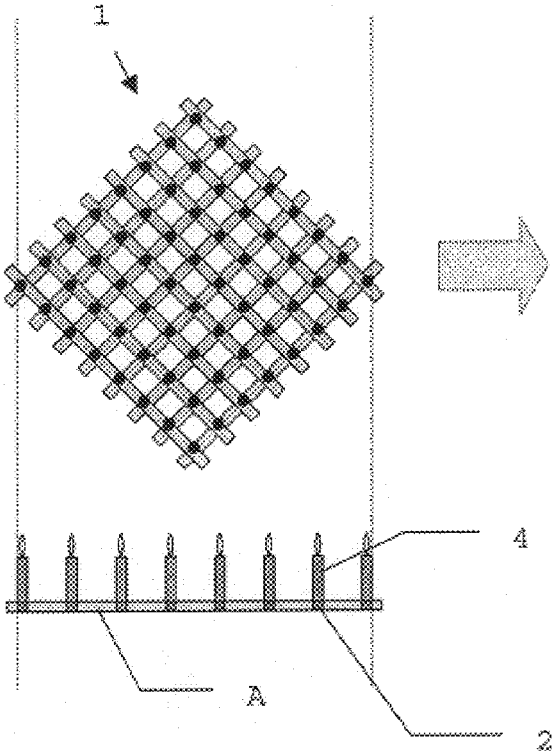
FIG. 2*a* shows the exemplary embodiment of a candle holder according to the invention, in the second position, in plan view.

The second position of this candle holder is shown in FIG. 2*a,* in which the candles 4 fastened to the bearer elements 2 are at the spacing A for use.

Figure 2B:
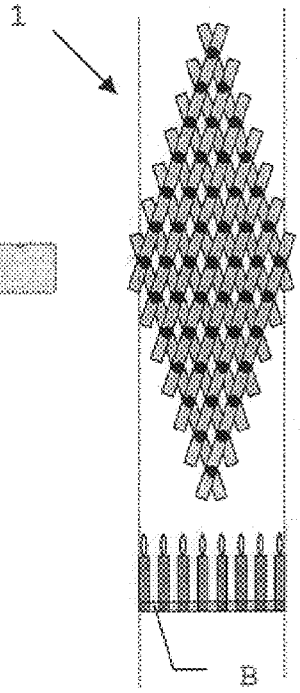
FIG. 2*b* shows the same candle holder in the first position, in plan view.

As shown in FIG. 2*b,* the distance between the candles 4 is reduced in the direction toward the igniting distance B by pushing together the candle holder, and is increased in the direction perpendicular thereto.

Figure 3:
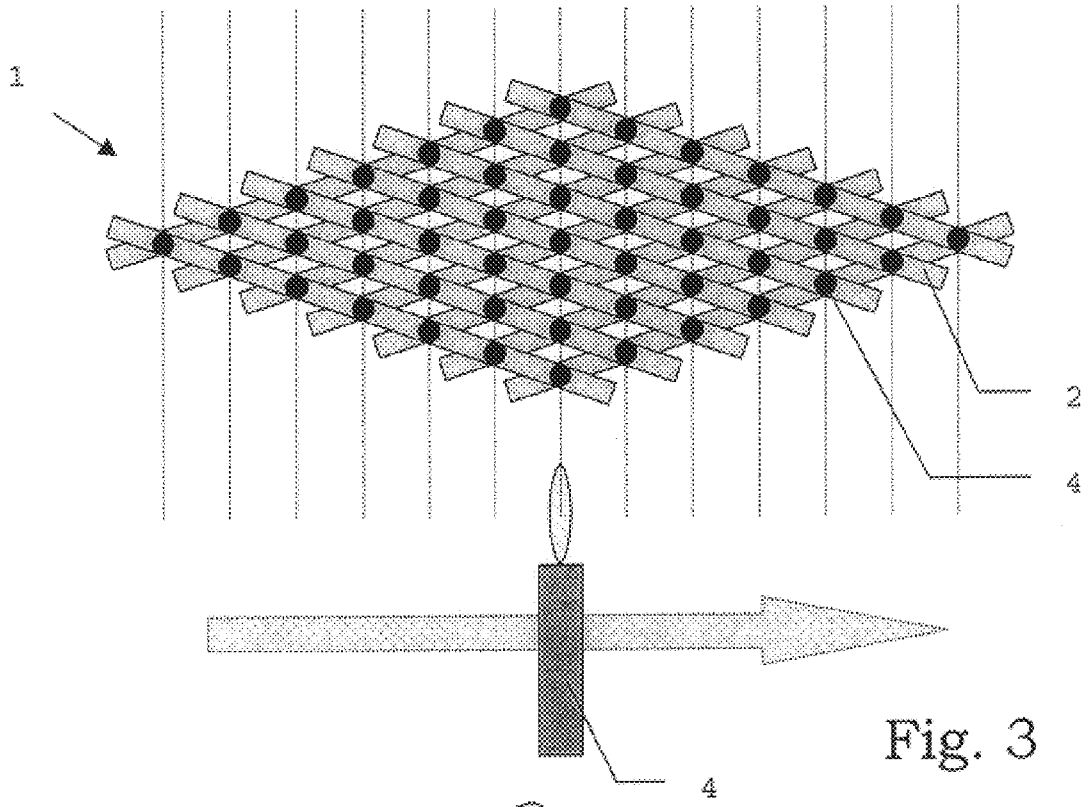
FIG. 3 shows a schematic representation of the lighting of candles for an exemplary embodiment of a candle holder according to the invention.

In FIG. 3, the candles 4 now positioned in a plurality of rows at the igniting distance on the bearer elements 2 are recognizable. For lighting, the candle holder 1 is turned so that the candles 4 in a row are present one on top of the other. A burning candle moved along the lowermost candles of the row lights this lowermost candle, from which the flame is then transmitted to the other candles of the row.

Figure 4:
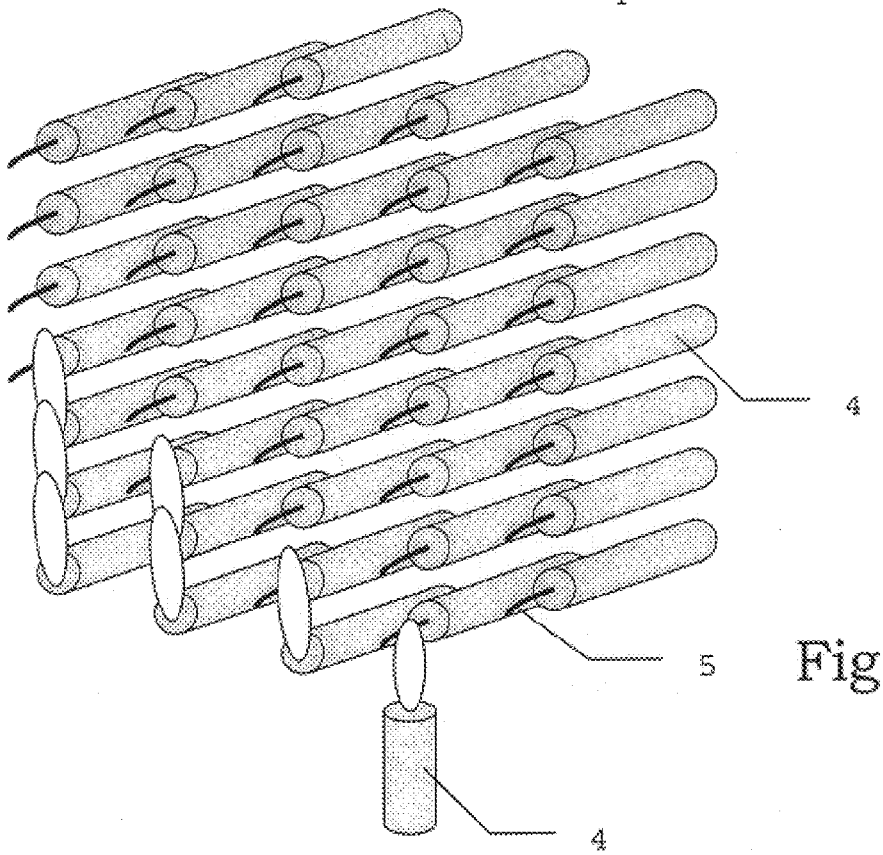
FIG. 4 shows a figurative representation of the lighting of candles for an exemplary embodiment of a candle holder according to the invention.

FIG. 4 shows this procedure in the figurative representation. The candle 4 is moved from right to left so that this flame touches the wicks 5 of the lowermost candles of a row. The first three rows have already been lit in their bottom region, and the ignition can spread upward to the further candles of the row. If the lowermost candles of all rows have been passed, all remaining candles light independently through the gradual transmission of the flames upward from below.

Figure 5:
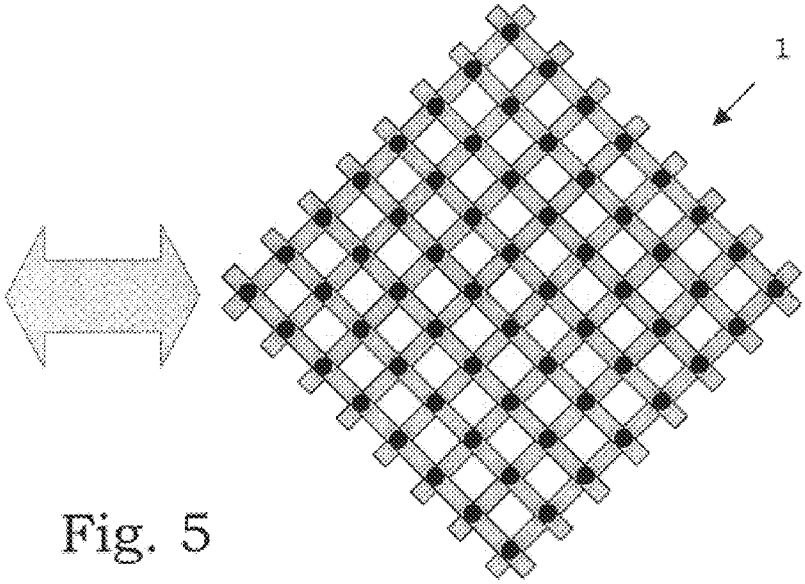
FIG. 5 shows the change in the candle holder from the first to the second position.

Finally, when all candles have been lit, the candle holder 1 can be moved back to the second position, as shown in FIG. 5.

Figure 6A:
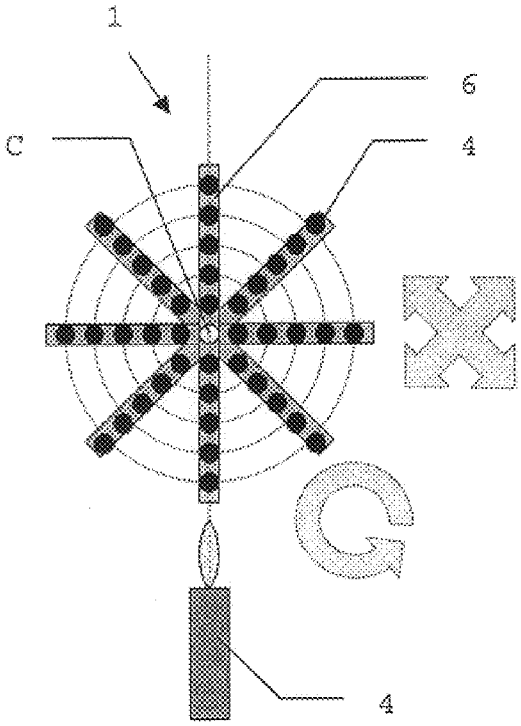
FIG. 6*a* shows a wheel-like embodiment of a candle holder according to the invention, in first position, in plan view.

An alternative wheel-like or star-like embodiment of the candle holder 1 according to the invention is shown schematically in FIG. 6*a,* in the first position. The candles 4 are now fastened to the bearer elements, which in turn form holding arms 6 or are displaceably connected to the separate holding arms 6 and which are fastened in a star-like manner to a common fixed point C. By rotating the candle holder 1 positioned perpendicularly to a separate candle 4, the outermost candles 4 of a row which are present at the ignition distance are lit and the ignition is transmitted upward toward the common fixed point C.

Figure 6B:
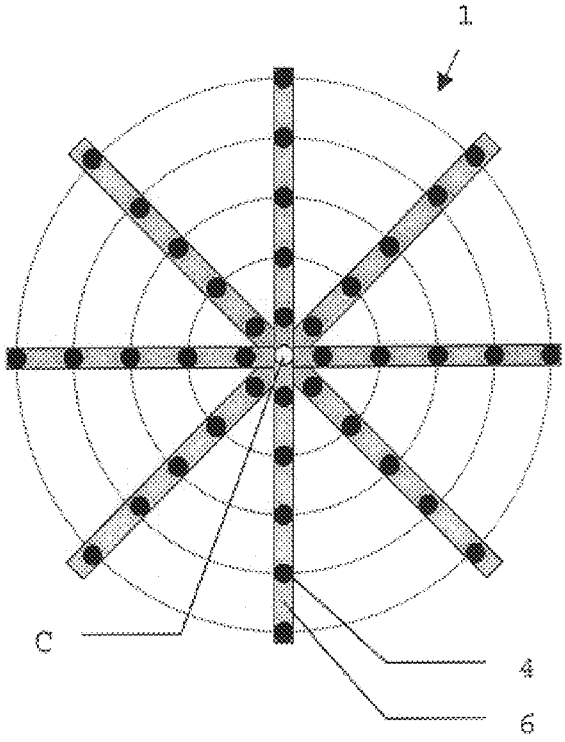
FIG. 6*b* shows the same candle holder in the second position, in plan view.

After complete ignition of all candles 4, the candle holder 1 can be brought into the second position by stretching the holding arms 6, as shown in FIG. 6*b*.

Figure 7:
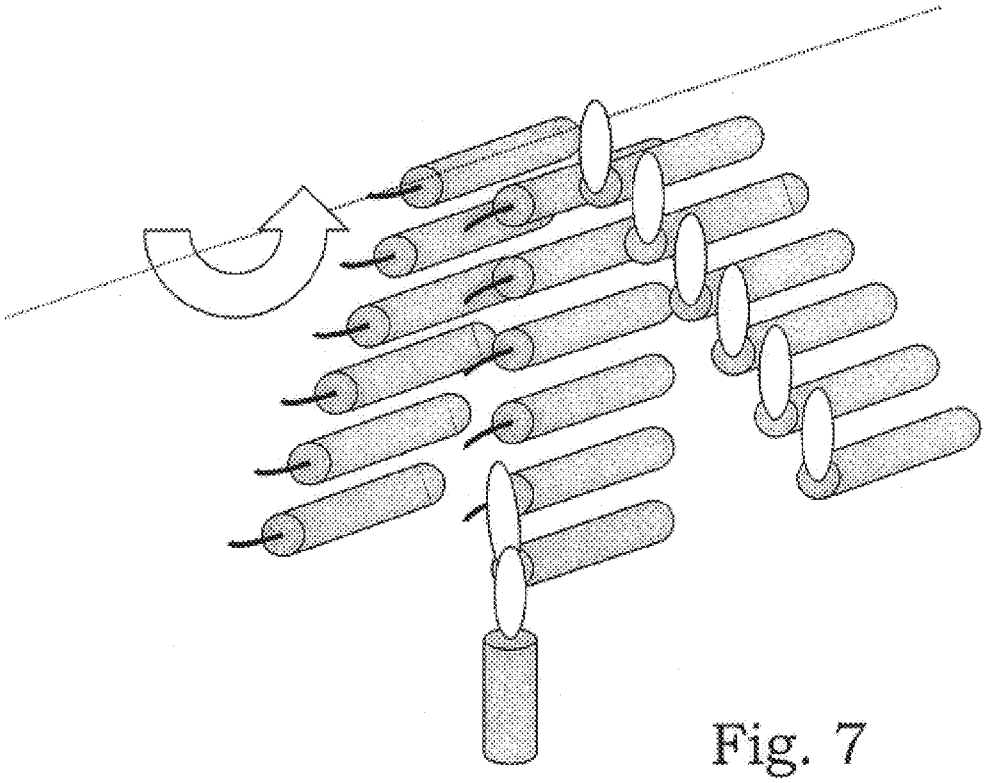
FIG. 7 shows a figurative representation of the lighting of candles for the same candle holder.

The lighting process is shown figuratively in FIG. 7. It should be noted here that, after lighting of the lowermost candle 4 in each case, it is necessary to wait until all candles of a row have been lit since further rotation of the candle holder eliminates the perpendicular positioning of the candles 4 one on top of the other for the respective row.

Figure 8:
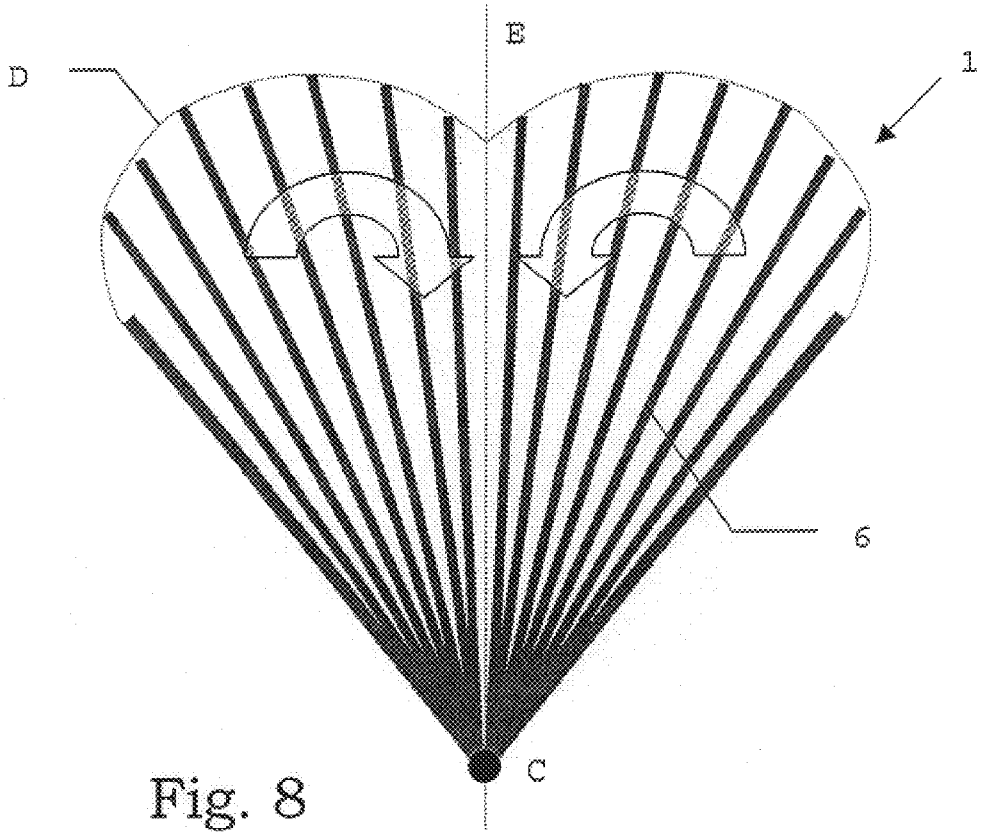
FIG. 8 shows a second heart-shaped embodiment of a candle holder according to the invention in the second position, in plan view.

A further heart-shaped or fan-shaped embodiment of the candle holder 1 according to the invention is shown in FIG. 8.

The holding arms 6 of the candle holder are fastened to one another at a common fixed point C. The individual holding arms 6 are of different lengths, the matching of which with one another in the second position gives the desired overall impression of a heart-shaped or fan-shaped overall figure D. The first position can be achieved by folding together the holding arms 6 toward a central line E of the overall figure D while simultaneously pushing together the holding arms 6.

Figure 9:
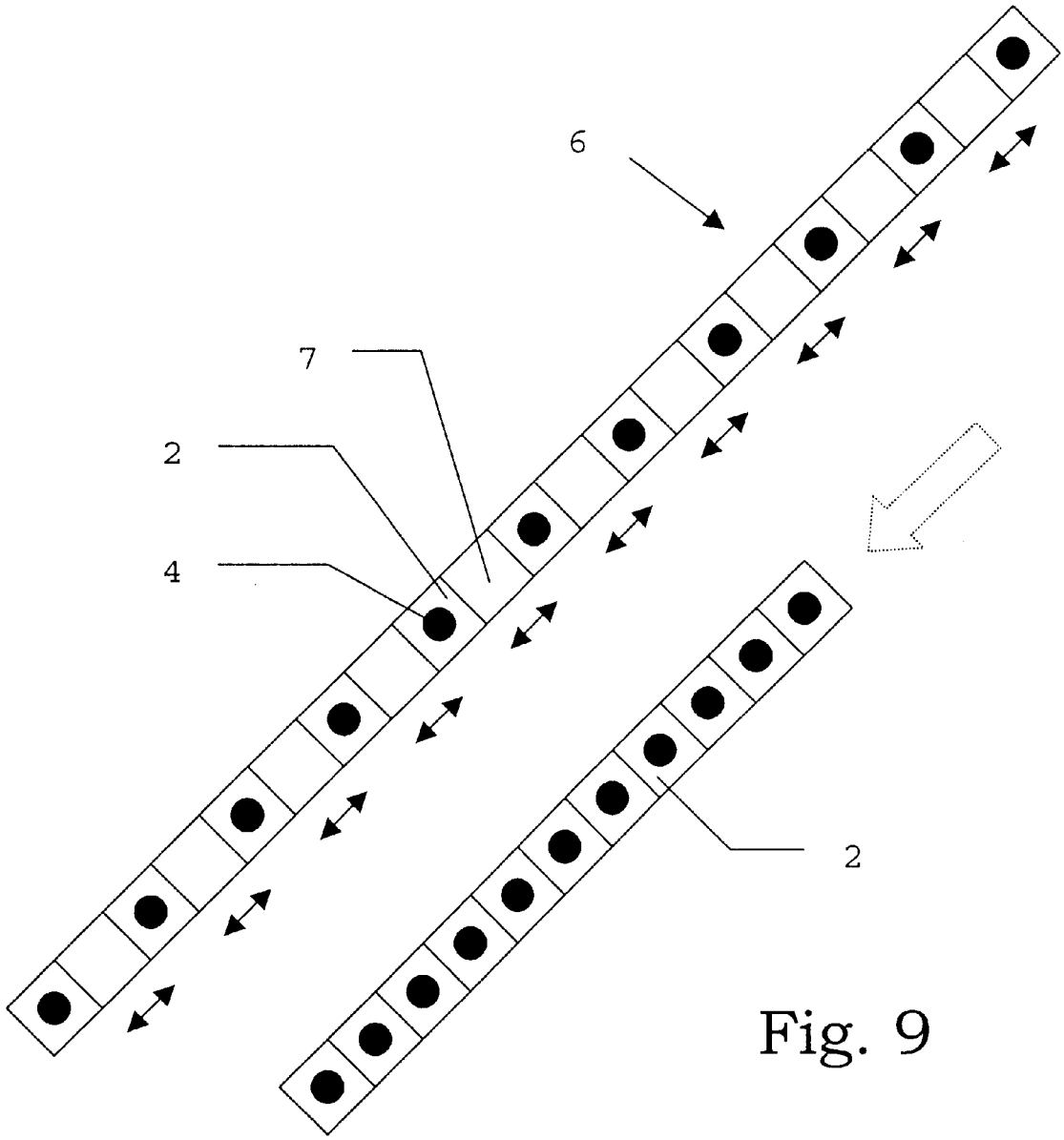
FIG. 9 shows an arm-like component belonging to this candle holder and comprising candle mounts displaceable relative to one another.

A holding arm 6 which can be used for this embodiment is shown in FIG. 9. One candle 4 in each case is present on a bearer element 2, which is connected to other bearer elements 2 of the same type, in each case by means of an intermediate part 7 on both sides. Only the bearer elements 2 at the end of the holding arm 6 have a fastening at intermediate part 7 only on one side. These intermediate parts 7 can be formed in such a way that they can be inserted into the bearer elements 2 so that the total holding arm 6 can be shortened telescopically.

Of course, the figures shown represent one embodiment out of many embodiments, and a person skilled in the art can derive alternative forms for realization, for example with the use of other materials, candle forms or geometries.

I claim:

1. A candle holder (1) for mounting on a support, comprising at least two bearer elements (2), on each of which at least one candle mount (3) is mounted, wherein the bearer elements (2) are displaceably connected to one another, and said candle mounts (3), that are related to said bearer elements (2), are arranged in a plane, whereby in a first position of the bearer elements, it being possible for wicks (5) of at least two candles (4) introducible or introduced in each case into the candle mounts to be brought into an ignition distance (B) relative to one another by a movement within said plane and it being possible for the bearer elements to be moved into a second position in which the wicks (5) are a larger distance (A) apart than the ignition distance.

2. The candle holder (1) as claimed in claim 1, wherein in the second position it being possible for the bearer elements to be moved by being pushed, turned or folded.

3. The candle holder (1), wherein the support comprises a bakery product.

4. The candle holder (1) as claimed in claim 1, comprising at least 3 candle mounts for holding at least 3 candles, wherein, in the first position, wicks (5) of at least three candles (4) introducible or introduced in each case into the candle mounts are arranged along a straight connecting line at the ignition distance (B) apart.

5. The candle holder (1) as claimed in claim 4, wherein the distance from wicks (5) of the candles (4) along the straight connecting line to wicks (5) of the candles (4) which do not lie along the straight connecting line is greater than the ignition distance.

6. The candle holder (1) as claimed in claim 1, wherein the bearer elements (2) are connected to one another so that, in the second position, the bearer elements are arranged in at least one of the following forms ring star fan grid.

7. The candle holder (1) as claimed claim 1, wherein at least two bearer elements (2) are displaceable relative to one another in a scissors-like manner.

8. The candle holder (1) as claimed in claim 7, wherein the at least two bearer elements are in a grid arrangement.

9. The candle holder as claimed in claim 1, wherein connections (7) between the bearer elements (2) are designed to be flexible, in the form of a hinge, in the form of a joint or in the form of a sliding connection.

* * * * *